US011069491B2

(12) United States Patent
Huang

(10) Patent No.: US 11,069,491 B2
(45) Date of Patent: Jul. 20, 2021

(54) KEY STRUCTURE

(71) Applicant: Silitek Electronics (Dongguan) Co., Ltd, Guangdong (CN)

(72) Inventor: Yong-Zheng Huang, Guangdong (CN)

(73) Assignee: Silitek Electronics (Dongguan) Co., Ltd

( * ) Notice: Subject to any disclaimer, the term of this patent is extended or adjusted under 35 U.S.C. 154(b) by 0 days.

(21) Appl. No.: 16/901,903

(22) Filed: Jun. 15, 2020

(65) Prior Publication Data

US 2021/0142965 A1 May 13, 2021

(30) Foreign Application Priority Data

Nov. 13, 2019 (CN) ..... 201911106911.1

(51) Int. Cl.
*H01H 13/14* (2006.01)
*H01H 13/04* (2006.01)
*H01H 13/20* (2006.01)

(52) U.S. Cl.
CPC ..... *H01H 13/14* (2013.01); *H01H 13/04* (2013.01); *H01H 13/20* (2013.01); *H01H 2233/07* (2013.01)

(58) Field of Classification Search
CPC .... H01H 13/14; H01H 3/125; H01H 13/7065; H01H 2221/044; H01H 2221/036; H01H 13/48; H01H 13/52; H01H 13/56; H01H 13/20; H01H 13/36; H01H 13/365; H01H 15/02; H01H 15/06; H01H 1/242; H01H 13/12; H01H 13/28
See application file for complete search history.

(56) References Cited

U.S. PATENT DOCUMENTS

2017/0221653 A1* 8/2017 Liao ..... H01H 13/023

* cited by examiner

*Primary Examiner* — Ahmed M Saeed
(74) *Attorney, Agent, or Firm* — Innovation Counsel LLP

(57) ABSTRACT

A key structure includes a keycap and an actuator. The actuator is coupled with the keycap and enables the keycap to move reciprocally along an actuating direction. One of the actuator and the keycap has a base and a slot formed therein, and the other one of the same has a plug. The plug is inserted into the slot in a direction parallel to the actuating direction. The slot has an inner wall pressing the plug and generating friction. The base has a first sidewall thickness perpendicular to the actuating direction and parallel to the inner wall and a second sidewall thickness perpendicular to the actuating direction and perpendicular to the inner wall, wherein the first sidewall thickness is greater than the second sidewall thickness. The disclosure can avoid the horizontal stress generated by the plug when it is inserted into the slot to squeeze against the bas.

10 Claims, 5 Drawing Sheets

KEY STRUCTURE

This application claims the benefit of People's Republic of China application Serial No. 201911106911.1, filed Nov. 13, 2019, the subject matter of which is incorporated herein by reference.

BACKGROUND

Technical Field

The disclosure relates in general to a key structure, and more particularly to a key structure providing mechanical press feeling.

Description of the Related Art

Input device is normally used as a communication interface between the user and the electronic device. The input device, such as a plurality of key structures. By pressing different keys, the user can enable the electronic device to generate corresponding actions. Of the different types of key structure, the mechanical key structure possessing the advantages of better hand touch, longer lifespan and shorter triggering course has won a great popularity over the years.

Typical mechanical key structure at least includes a keycap, a switch and a bottom plate. The keycap is disposed on the bottom plate and can move reciprocally up and down through the switch. The keycap, limited by the switch, can move reciprocally between the top end position and the bottom end along the vertical axis direction. When the keycap is pressed, the keycap can move to the bottom end position from the top end position and cause the switch to generate a triggering signal.

The switch and the keycap are tightly engaged and connected through the plug located at the top of the switch and the slot located at the bottom surface of the keycap. However, if the engaging stress between the plug and the slot is too large, the sidewall of the slot may easily rupture, which will further enlarge the process variation and adversely affect the yield rate and the quality of the mechanical key structure.

Therefore, it has become a prominent task for the industry to provide an advanced key structure which has improved yield rate and the quality and is able to resolve the current technical problems.

SUMMARY

One aspect of the present disclosure is to provide a key structure whose design can prevent the base having a slot from being ruptured due to a horizontal stress generated by a plug when it is inserted into the slot to squeeze against the base.

According to one embodiment of the present disclosure, a key structure comprising a keycap and an actuator is provided. The actuator is coupled with the keycap and enables the keycap to move reciprocally along an actuating direction. One of the actuator and the keycap has a base and a slot formed in the base. The other one of the actuator and the keycap has a plug. The plug is inserted into the slot in a direction parallel to the actuating direction. The slot has an inner wall pressing the plug and generating friction. The base has a first sidewall thickness and a second sidewall thickness. The first sidewall thickness is perpendicular to the actuating direction and parallel to the inner wall, the second sidewall thickness is perpendicular to the actuating direction and perpendicular to the inner wall, and the first sidewall thickness is greater than the second sidewall thickness.

Wherein, the plug is protruded from a top of the actuator, and the base is a convex column protruded from a bottom surface of the keycap.

Wherein, the plug comprises a first fin and a second fin, which come cross with each other and extend upward from the top of the actuator in a direction parallel to the actuating direction to form a cross-shaped column structure; the slot, being a cross-shaped recess, comprises a first groove and a second groove, which come cross with each other and respectively receive the first fin and the second fin.

Wherein, the first fin is greater than or equivalent to a width of the first groove, the second fin is smaller than or equivalent to a width of the second groove, and the inner wall is located in the first groove and squeezed against a sidewall of the first fin.

Wherein, the convex column has a cross-section perpendicular to the actuating direction, and the cross-section has a long axis perpendicular to the actuating direction and parallel to the inner wall and a short axis perpendicular to the inner wall.

Wherein, the first sidewall thickness is measured from the two ends of the long axis to the edge of the base, and the second sidewall thickness is measured from the two ends of the short axis to the edge of the base.

Wherein, the cross-section is an elliptical cross-section, a rectangular cross-section or a cross-shaped cross-section.

Wherein, the actuator is a mechanical switch configured to provide the keycap an elastic force, which enables the keycap to move reciprocally along the actuating direction.

Wherein, the actuator is a plunger switch, which moves reciprocally with the keycap along the actuating direction.

Wherein, the base is a convex column protruded from a top of the actuator, and the plug is protruded from a bottom surface of the keycap.

According to aforementioned embodiments of the present disclosure, a key structure is provided. The key structure comprises a keycap and an actuator. The actuator is coupled with the keycap by a plug and a slot (located in the base) and enables the keycap to move reciprocally along an actuating direction. By asymmetrically increasing the sidewall thickness of the slot (base), the base has a first sidewall thickness and a second sidewall thickness. The first sidewall thickness is perpendicular to the actuating direction and parallel to the inner wall on which the plug squeezes against the slot and generates friction, the second sidewall thickness is perpendicular to the actuating direction and perpendicular to the inner wall, and the first sidewall thickness is greater than the second sidewall thickness. The design of the key structure can prevent the base from being ruptured due to the horizontal stress generated by the plug when it is inserted into the slot to squeeze against the base.

The above and other aspects of the disclosure will become better understood with regard to the following detailed description of the preferred but non-limiting embodiment (s). The following description is made with reference to the accompanying drawings.

DETAILED DESCRIPTION

The embodiments of the present disclosure provide a key structure to resolve the problems of a slot being easily ruptured due to a plug being inserted into the slot to couple the keycap and the switch, thus improve the yield and the quality of the key structure. For the object, technical features and advantages of the present invention to be more easily understood by anyone ordinary skilled in the technology field, a number of exemplary embodiments are disclosed below with detailed descriptions and accompanying drawings.

It should be noted that these embodiments are illustrative and for explanatory purposes only, not for limiting the scope of protection of the invention. The invention can be implemented by using other features, elements, methods and parameters. The preferred embodiments are merely for illustrating the technical features of the disclosure, not for limiting the scope of protection. Anyone skilled in the technology field of the disclosure will be able to make suitable modifications or changes based on the specification disclosed below without breaching the spirit of the disclosure. Designations common to the accompanying drawings are used to indicate identical or similar elements.

Figure 1A:
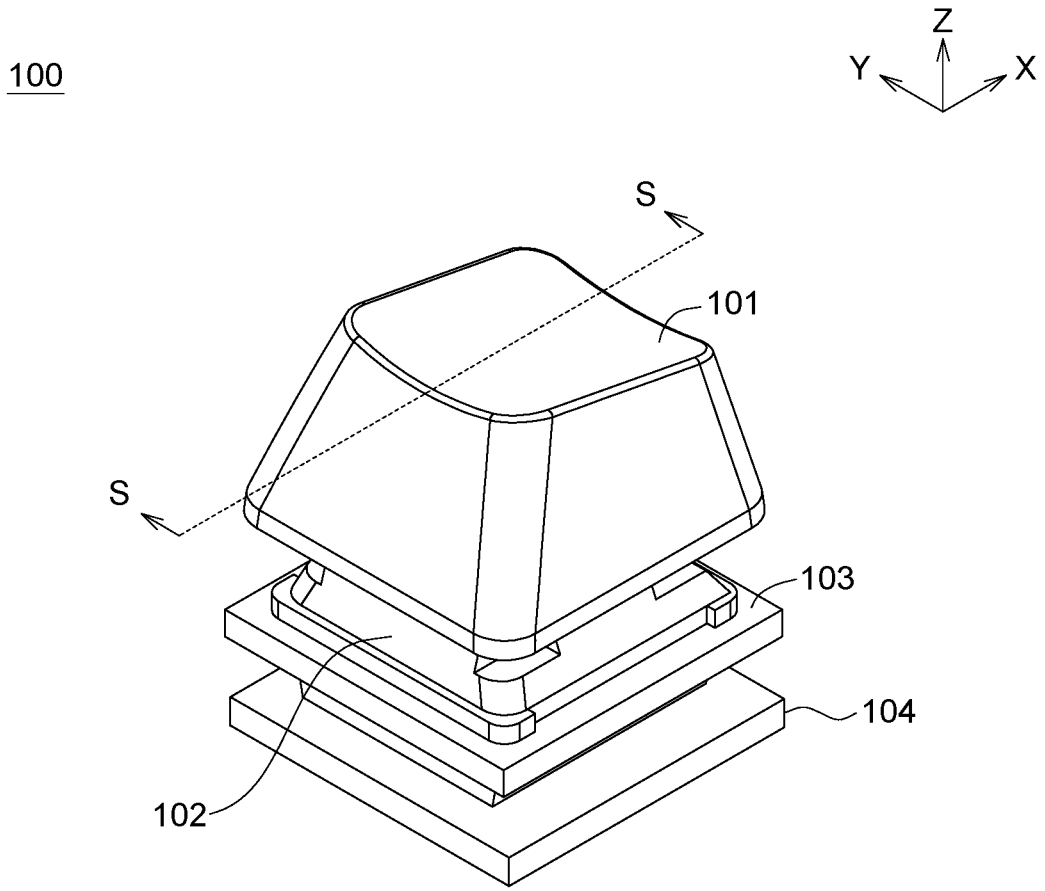
FIG. 1A is a 3D assembly diagram of a key structure according to an embodiment of the disclosure.
Figure 1B:
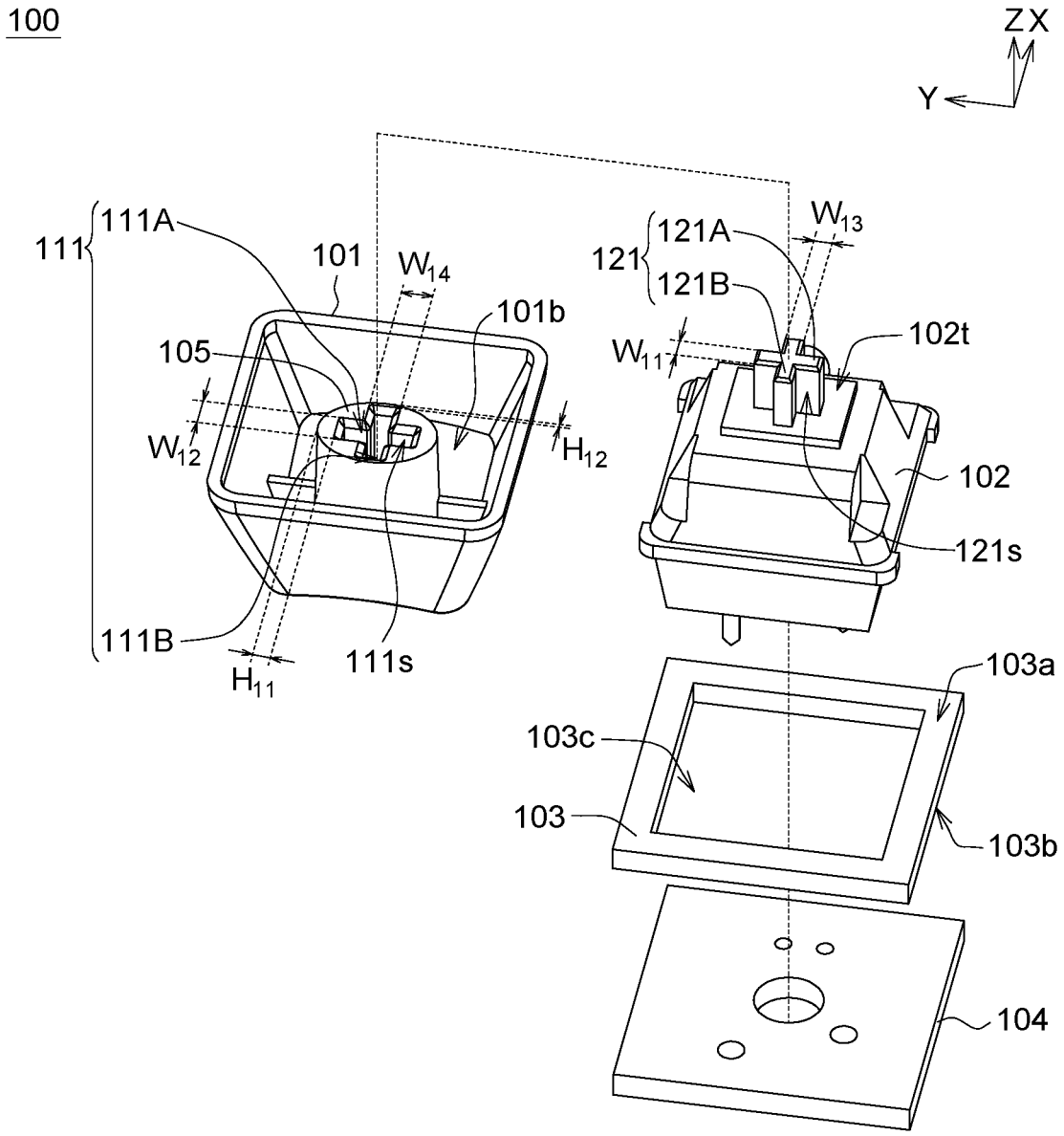
FIG. 1B is a 3D explosion diagram of the key structure of FIG. 1A.
Figure 1C:
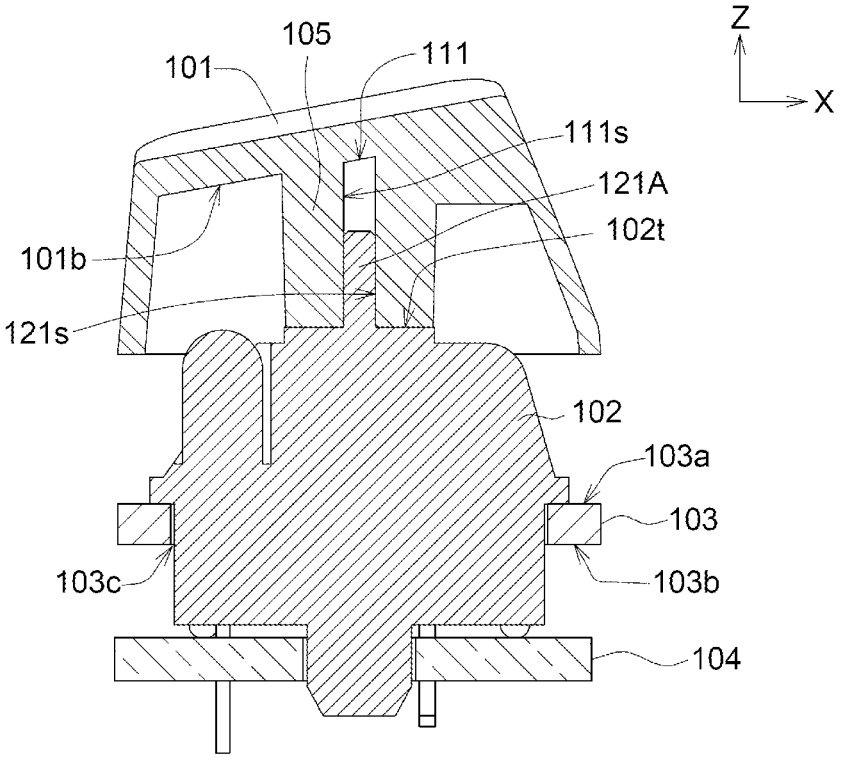
FIG. 1C is a partial cross-sectional view of a key structure taken along the tangent line S of FIG. 1A.
Figure 1D:
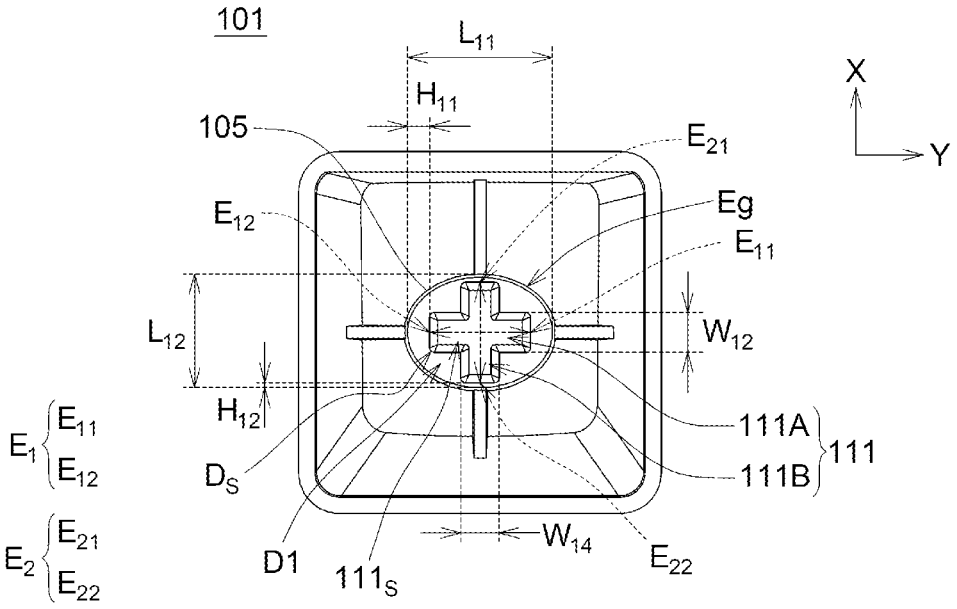
FIG. 1D is a bottom view of the keycap structure of FIG. 1A.

FIG. 1A is a 3D assembly diagram of a key structure 100 according to an embodiment of the disclosure; FIG. 1B is a 3D explosion diagram of the key structure 100 of FIG. 1A; FIG. 1C is a partial cross-sectional view of the key structure 100 along the tangent line S of FIG. 1A; and FIG. 1D is a bottom view of the keycap structure 100 of FIG. 1A. In some embodiments of the disclosure, the key structure 100 can be adapted to a keyboard of an electronic device, such as a laptop or a desktop computer, to trigger a specific signal.

Refer to FIG. 1A, the key structure 100 includes a keycap 101, an actuator 102, a bottom plate 103 and a circuit board 104. The keycap 101 can be used in a horizontal bar key (such as the space key) or a key with normal size (such as a letter key). In the present embodiment, the keycap 101 is a normal size key.

The actuator 102 is disposed on the bottom plate 103 and coupled with the keycap 101. The bottom plate 103 includes a top surface 103*a* and a bottom surface 103*b* opposite to the top surface 103*a*. Besides, the bottom plate 103 further includes a receiving hole 103*c*, which passes through the top surface 103*a* and the bottom surface 103*b* and enables the actuator 102 to be disposed in the bottom plate 103.

In some embodiments of the disclosure, the actuator 102, which can be a mechanical switch, includes at least one elastic force element, such as (but not illustrated to) a spring (not shown), configured to provide an elastic force, which enables the keycap 101 to move reciprocally along the Z-axis direction (also referred as an actuating direction) after the actuator 102 and the keycap 101 are coupled together. In detail, when the user presses the keycap 101, the keycap 101 moves towards the bottom plate 103 along the Z-axis direction. Meanwhile, the elastic force element of the actuator 102 provides the keycap 101 with a restore elastic force away from the bottom plate 103 along the Z-axis; when the user no more presses the keycap 101, the restore elastic force enables the keycap 101 to move to the original position before the keycap 101 is pressed from the bottom plate 103.

In some other embodiments of the disclosure, the actuator 102, which can be a plunger switch, which is inserted into a guide member (not illustrated) and adjacent to the two sides of the switch of the key structure 100. When the keycap 101 is driven by the switch, the actuator 102 moves reciprocally along the Z-axis direction to guide and limit the keycap 101 to move reciprocally within a specific range along the Z-axis direction.

The actuator 102 may include pins (not shown). When the actuator 102 is disposed on the bottom plate 103, the pins can be inserted on the circuit board 104 and fixed though tin furnace welding to electrically connect the circuit board 104. When the keycap 101 is moved to the pressed position from the un-pressed position, the actuator 102 can generate a trigger signal transmitting to the circuit board 104.

In detail, the keycap 101 includes a base 105 and a slot 111 formed in the base 105, wherein the base 105 is disposed on the bottom surface 101*b* of the keycap 101 and extends downward from the bottom surface 101*b* along the Z-axis direction. The top 102*t* of the actuator 102 includes a plug 121 which extends upward from the top 102*t* of the actuator 102. The shape of the plug 121 corresponds to that of the slot 111, such that the plug 121 can be inserted into the slot 111.

In some embodiments of the disclosure, the plug 121 can be a cross-shaped column structure including a first fin 121A and a second fin 121B, which may come cross with each other and extend upward from the top 102*t* of the actuator 102 in a direction parallel to the Z-axis direction. The base 105 can be a convex column protruded from the bottom surface 101*b* of the keycap 101. The shape of the slot 111 corresponds to that of the plug 121. The slot 111 can be a cross-shaped recess including a first groove 111A and a second groove 111B, which come cross with each other and respectively correspond to the first fin 121A and the second fin 121B.

In the present embodiment, the first fin 121A is perpendicular to the second fin 121B; the width W11 of the first fin 121A is greater than or equivalent to the width W12 of the first groove 111A; the width W13 of the second fin 121B is smaller than or equivalent to the width W14 of the second groove 111B. When the plug 121 is inserted into the slot 111, since the width W11 of the first fin 121A is not over the width W12 of the first groove 111A, thus the sidewall 121*s* of the first fin 121A can squeeze against the inner wall 111*s* of the first groove 111A and make the plug 121 tightly engaged with the base 105. The second fin 121B and the second groove 111B can just contact without squeezing against each other.

In order to avoid the base 105 (convex column) being ruptured by the horizontal stress (the squeeze) resulted from the tight engage between the first fin 121A and the first groove 111A, in some embodiments of the disclosure, the sidewall thickness of the base 105 at the two ends of the first groove 111A can be increased to be greater than the sidewall thickness of the base 105 at the two ends of the second groove 111B. That is, the base 105 has a first sidewall thickness H11 and a second sidewall thickness H12. The first sidewall thickness H11 is perpendicular to the Z-axis and parallel to the inner wall 111*s* of the first groove 111A, the second sidewall thickness H12 is perpendicular to the Z-axis and perpendicular to the inner wall 111*s* of the first groove 111A, and the first sidewall thickness H11 is greater than the second sidewall thickness H12. In detail, the slot 111 has a cross-section Ds perpendicular to the actuating direction (Z-axis direction). The first groove 111A has a first extending axis E1 perpendicular to the actuating direction (Z-axis direction) and parallel to the inner wall 111*s*; and the second groove 111B has a second extending axis E2 perpendicular both to the actuating direction (Z-axis direction) and the inner wall 111*s*. The first sidewall thickness H11 is measured from one end (the end E11 or E12) of the first extending axis E1 to an edge Eg of the base 105, and the second sidewall thickness H12 is measured from one end (the end E21 or E22) of the second extending axis E2 to the edge Eg of the base 105.

Thus, the base 105 has an asymmetric cross-section D1 perpendicular to the Z-axis direction. The cross-section D1 has a long axis L11 and a short axis L12, wherein the long axis L11 is perpendicular to the Z-axis and parallel to the inner wall 111*s* of the first groove 111A, and the short axis L12 is perpendicular to the long axis L11. In the present embodiment, the asymmetric cross-section D1 of the base 105 can be an ellipse, but the shape of the asymmetric cross-section D1 of the base 105 is not limited thereto.

Figure 2:
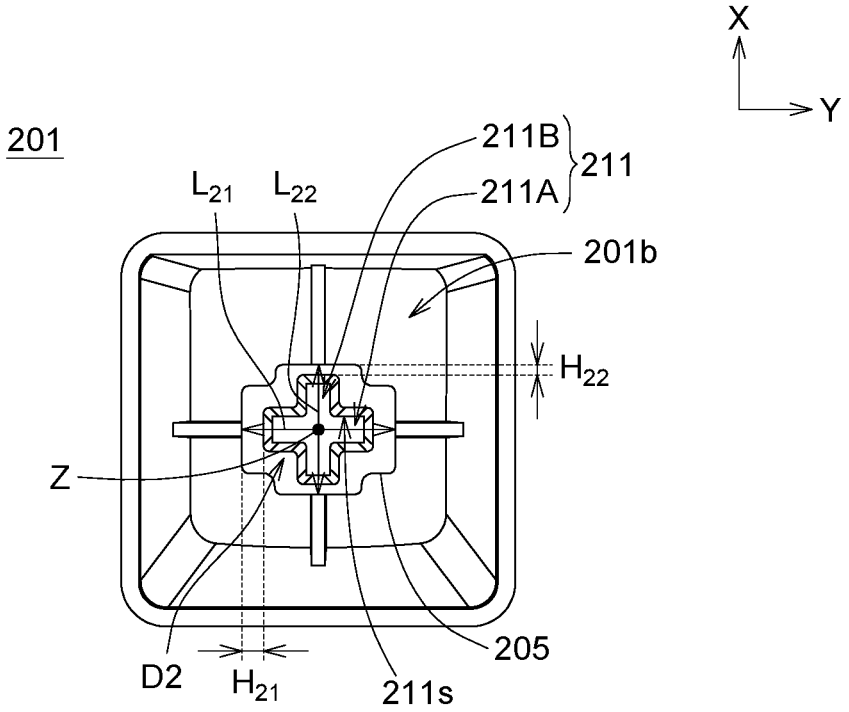
FIG. 2 is a bottom view of a keycap structure according to another embodiment of the disclosure.

Referring to FIG. 2, a bottom view of a keycap structure 201 according to another embodiment of the disclosure is shown. As indicated in FIG. 2, the base 205, disposed on the bottom surface 201*b* of the keycap 201, has a cross-shaped slot 211. The cross-shaped slot 211 includes a first groove 211A and a second groove 211B, which come cross with each other. The base 205 has an asymmetric cross-shaped cross-section D2 perpendicular to the Z-axis direction. The cross-section D2 has a long axis L21 and a short axis L22, wherein the long axis L21 perpendicular to the Z-axis and parallel to the inner wall 211*s* of the first groove 211A, and the short axis L22 is perpendicular to the long axis L21. The base 205 has a first sidewall thickness H21 and a second sidewall thickness H22. The first sidewall thickness H21 is perpendicular to the Z-axis and parallel to the inner wall 211*s* of the first groove 211A, the second sidewall thickness H22 is perpendicular to the Z-axis and perpendicular to the inner wall 211*s* of the first groove 211A, and the first sidewall thickness H21 is greater than the second sidewall thickness H22.

Figure 3:
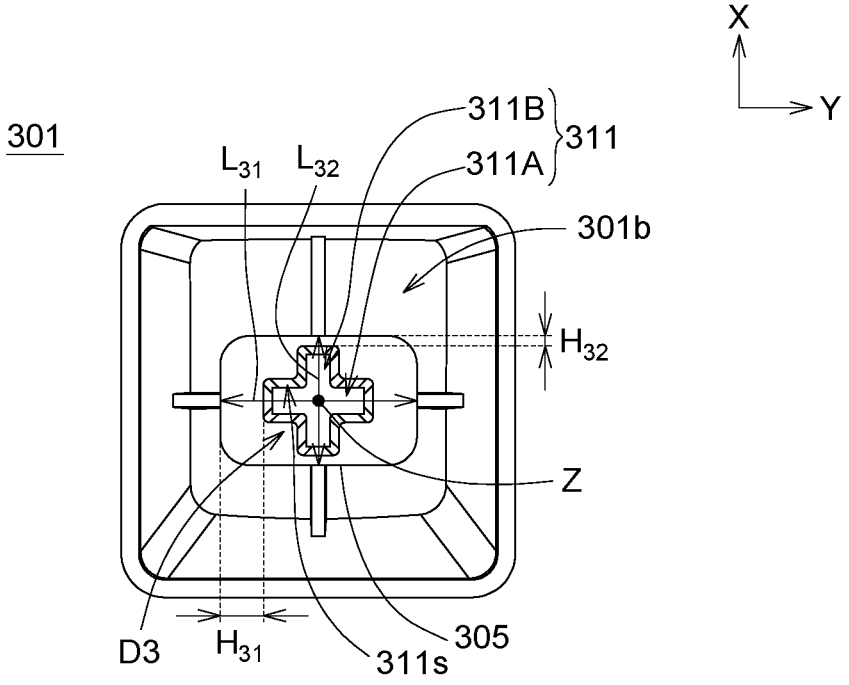
FIG. 3 is a bottom view of a keycap structure according to an alternate embodiment of the disclosure.

Referring to FIG. 3, a bottom view of a keycap structure 301 according to an alternate embodiment of the disclosure is shown. As indicated in FIG. 3, the base 305, disposed on the bottom surface 301*b* of the keycap 301, has a cross-shaped slot 311. The cross-shaped slot 311 includes a first groove 311A and a second groove 311B, which come cross with each other. The base 305 has an asymmetric rectangular cross-section D3 perpendicular to the Z-axis direction. The cross-section D3 has a long axis L31 and a short axis L32, wherein the long axis L31 is perpendicular to the Z-axis and parallel to the inner wall 311*s* of the first groove 311A, and the short axis L32 is perpendicular to the long axis L31. The base 305 has a first sidewall thickness H31 and a second sidewall thickness H32. The first sidewall thickness H31 is perpendicular to the Z-axis and parallel to the inner wall 311*s* of the first groove 311A, the second sidewall thickness H32 is perpendicular to the Z-axis and perpendicular to the inner wall 311*s* of the first groove 311A, and the first sidewall thickness H31 is greater than the second sidewall thickness H32.

Figure 4:
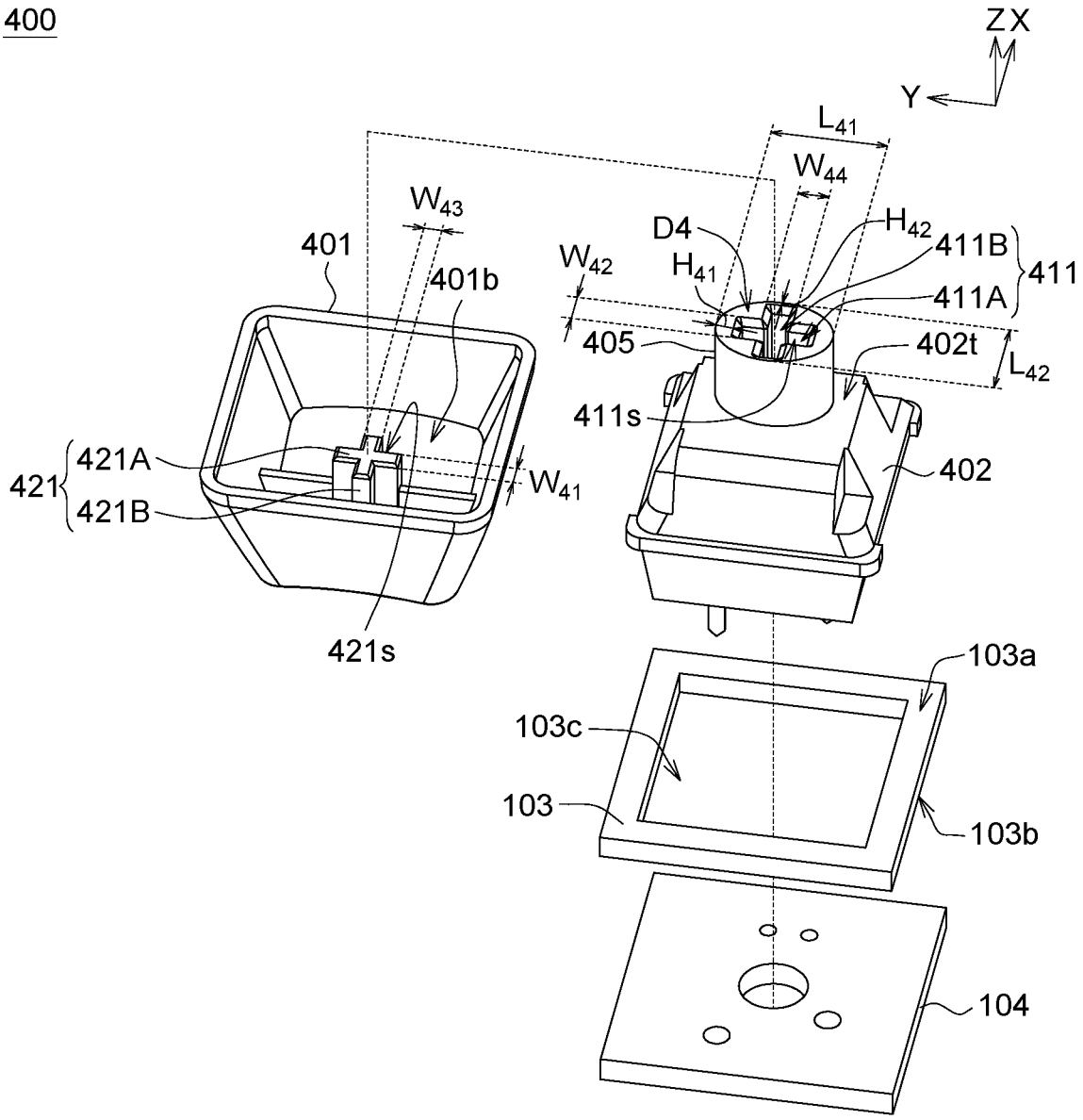
FIG. 4 is a 3D explosion diagram of a key structure according to yet another embodiment of the disclosure.

Referring to FIG. 4, a 3D explosion diagram of a key structure 400 according to another alternate embodiment of the disclosure is shown. The structure of the key structure 400 is similar to that of the key structure 100 of FIG. 1A to FIG. 10 except that the plug 421 of the key structure 400 can be disposed on the bottom surface 401*b* of the keycap 401 and that the base 405 with the slot 411 can be correspondingly disposed on the top 402*t* of the actuator 402.

In the present embodiment, the plug 421, which can be a cross-shaped column structure including a first fin 421A and a second fin 421B, which come cross with each other and extend upward in a direction parallel to the bottom surface 401*b* of the keycap 401 along the Z-axis direction. The base 405 can be a convex column protruded from the top 402*t* of the actuator 402. The shape of the slot 411 corresponds to that of the plug 421. The slot 411 can be a cross-shaped recess including a first groove 411A and a second groove 411B, which come cross with each other and respectively correspond to the first fin 421A and the second fin 421B.

The first fin 421A is perpendicular to the second fin 421B. The width W41 of the first fin 421A is greater than or equivalent to the first groove 411A the width W42. The width W43 of the second fin 421B smaller than or equivalent to the second groove 411B the width W44. When the plug 421 is inserted into the slot 411, since the width W41 of the first fin 421A is over the width W42 of the first groove 411A, thus the sidewall 421*s* of the first fin 421A can squeeze against the inner wall 411*s* of the first groove 411A and make the plug 421 tightly engaged with the base 405. The second fin 421B and the second groove 411B only contact but do not engage with each other.

In order to avoid the base 405 (convex column) being ruptured by the horizontal stress (the squeeze) resulted from the tight engage between the first fin 421A and the first groove 411A the sidewall thickness of the base 405 at the two ends of the first groove 411A can be increased to be greater than the sidewall thickness of the base 405 at the two ends of the second groove 411B. That is, the base 405 has a first sidewall thickness H41 and a second sidewall thickness H42. The first sidewall thickness H41 is perpendicular to the Z-axis and parallel to the inner wall 111*s* of the first groove 411A, the second sidewall thickness H42 is perpendicular to the Z-axis and perpendicular to the inner wall 411*s* of the first groove 411A, and the first sidewall thickness H41 is greater than the second sidewall thickness H42.

Thus, the base 405 has an asymmetric cross-section D4 perpendicular to the Z-axis direction. The cross-section D4 has a long axis L41 and a short axis L42, wherein the long axis L41 is perpendicular to the Z-axis and parallel to the inner wall 411*s* of the first groove 411A, and the short axis L42 is perpendicular to the long axis L41. In the present embodiment, the shape of the asymmetric cross-section D4 of the base 405 can be an ellipse. The structures of other elements of the key structure 400 are already disclosed above, and are not repeated there.

According to the above embodiments of the present disclosure, a key structure is provided. The key structure includes a keycap and an actuator. The actuator is coupled with the keycap by a plug and a slot (located in the base) and enables the keycap to move reciprocally along an actuating direction. By asymmetrically increasing the sidewall thickness of the slot (base), the base has a first sidewall thickness and a second sidewall thickness. The first sidewall thickness is perpendicular to the actuating direction and parallel to the inner wall on which the plug squeezes against the slot and generates friction, the second sidewall thickness is perpendicular to the actuating direction and perpendicular to the inner wall, and the first sidewall thickness is greater than the second sidewall thickness. The design of the key structure can prevent the base from being ruptured due to avoids the horizontal stress generated by the plug when it is inserted into the slot to squeeze against the base.

While the disclosure has been described by way of example and in terms of the preferred embodiment (s), it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A key structure, comprising:

a keycap; and an actuator, wherein the actuator is coupled with the keycap and enables the keycap to move reciprocally along an actuating direction;

wherein, one of the actuator and the keycap has a base and a slot formed in the base, and the other one of the actuator and the keycap has a plug; the plug is inserted into the slot in a direction parallel to the actuating direction; the slot has an inner wall squeezing against the plug and generating friction; the base has a first sidewall thickness and a second sidewall thickness; the first sidewall thickness is perpendicular to the actuating direction and parallel to the inner wall, the second sidewall thickness perpendicular to the actuating direction and perpendicular to the inner wall, and the first sidewall thickness is greater than the second sidewall thickness;

wherein the slot is a cross-shaped recess comprising a first groove and a second groove cross each other and having a cross-section perpendicular to the actuating direction; the first groove has a first extending axis perpendicular to the actuating direction and parallel to the inner wall; the second groove has a second extending axis perpendicular both to the actuating direction and the inner wall; the first sidewall thickness is measured from one end of the first extending axis to an edge of the base, and the second sidewall thickness is measured from one end of the second extending axis to the edge of the base.

2. The key structure according to claim 1, wherein the plug is protruded from a top of the actuator, and the base is a convex column protruded from a bottom surface of the keycap.

3. The key structure according to claim 2, wherein the plug comprises a first fin and a second fin coming cross with each other and extending upward from the top the actuator in a direction parallel to the actuating direction to form a cross-shaped column structure; and the first groove and the second groove respectively receive the first fin and the second fin.

4. The key structure according to claim 3, wherein the first fin is greater than or equivalent to a width of the first groove, the second fin is smaller than or equivalent to a width of the second groove, and the inner wall is located in the first groove and squeezes against a sidewall of the first fin.

5. The key structure according to claim 2, wherein the convex column has a cross-section perpendicular to the actuating direction, and the cross-section has a long axis perpendicular to the actuating direction and parallel to the inner wall and a short axis perpendicular to the inner wall.

6. The key structure according to claim 5, wherein the first sidewall thickness is measured respectively from the two ends of the long axis to an edge of the base, and the second sidewall thickness is measured respectively from the two ends of the short axis to the edge of the base.

7. The key structure according to claim 5, wherein the cross-section is an elliptical cross-section, a rectangular cross-section or a cross-shaped cross-section.

8. The key structure according to claim 1, wherein the actuator is a mechanical switch configured to provide the keycap with an elastic force, which enables the keycap to move reciprocally along an actuating direction.

9. The key structure according to claim 1, wherein the actuator is a plunger switch, which moves reciprocally with the keycap along an actuating direction.

10. The key structure according to claim 1, wherein the base is a convex column protruded from a top of the actuator, and the plug is protruded from a bottom surface of the keycap.

* * * * *